US006351970B1

(12) United States Patent
Hahn et al.

(10) Patent No.: US 6,351,970 B1
(45) Date of Patent: Mar. 5, 2002

(54) METHOD FOR EXTRACTING XENON

(75) Inventors: Erich Hahn, Eurasburg; Wilhelm Rohde, München; Jürgen Voit, Schondorf, all of (DE)

(73) Assignee: Linde Gas Aktiengesellschaft, Höllriegelskreuth (DE)

( * ) Notice: Subject to any disclaimer, the term of this patent is extended or adjusted under 35 U.S.C. 154(b) by 0 days.

(21) Appl. No.: 09/701,240

(22) PCT Filed: May 5, 1999

(86) PCT No.: PCT/EP99/03079

§ 371 Date: Feb. 22, 2001

§ 102(e) Date: Feb. 22, 2001

(87) PCT Pub. No.: WO99/61853

PCT Pub. Date: Dec. 2, 1999

(30) Foreign Application Priority Data

May 26, 1998 (DE) ..... 198 23 526

(51) Int. Cl.[7] ..... F25J 1/00
(52) U.S. Cl. ..... 62/648; 62/925
(58) Field of Search ..... 62/925, 648

(56) References Cited

U.S. PATENT DOCUMENTS

| | | | | |
|---|---|---|---|---|
| 3,596,471 A | * | 8/1971 | Streich et al. | 62/925 |
| 3,751,934 A | * | 8/1973 | Frischbier | 62/925 |
| 4,401,448 A | | 8/1983 | LaClair | |
| 4,647,299 A | | 3/1987 | Cheung | |
| 5,067,976 A | * | 11/1991 | Agrawal et al. | 62/925 |

FOREIGN PATENT DOCUMENTS

| | | |
|---|---|---|
| FR | 2 280 954 | 2/1976 |
| GB | 1 189 975 | 4/1970 |

OTHER PUBLICATIONS

Daimer & Streich, "Recovery of Rare Gases in Air Separation and Ammonia Plants", Linde Reports on Science and Technology (1975), pp. 44–48.

* cited by examiner

*Primary Examiner*—Ronald Capossela
(74) *Attorney, Agent, or Firm*—Crowell & Moring LLP

(57) ABSTRACT

The invention relates to a method for extracting xenon and eventually also krypton from a liquid oxygen (LOX) charge, as it accrues in a cryogenic air separation system (LZA) during a rectification of the air, mostly as a bottom product of a low-pressure, column, namely with xenon (Xe), krypton (Kr) and hydrocarbons ($C_xH_y$) in a small concentration and approximately 99 mol % oxygen ($O_2$). According to the inventive method, the LOX charge is fed to a first column, the oxygen of the LOX charge is extensively removed by stripping with an inert gas, and is extracted in the top gas, whereas the inert gas is withdrawn in the form of a liquid from the bottom of the first column with little $O_2$ and nearly the total mass of $C_xH_y$, Kr, Xe. According to the invention, the liquid discharge is fed to a second column without prior catalytic and/or adsorptive removal of $C_xH_y$. A Kr fraction is extracted as top gas of the second column, and an Xe fraction is withdrawn from the bottom of the second column. The method can be used in a device for extracting Xe and/or Kr in an air separation system (LZA). The device can be arranged in a transportable container.

18 Claims, 1 Drawing Sheet

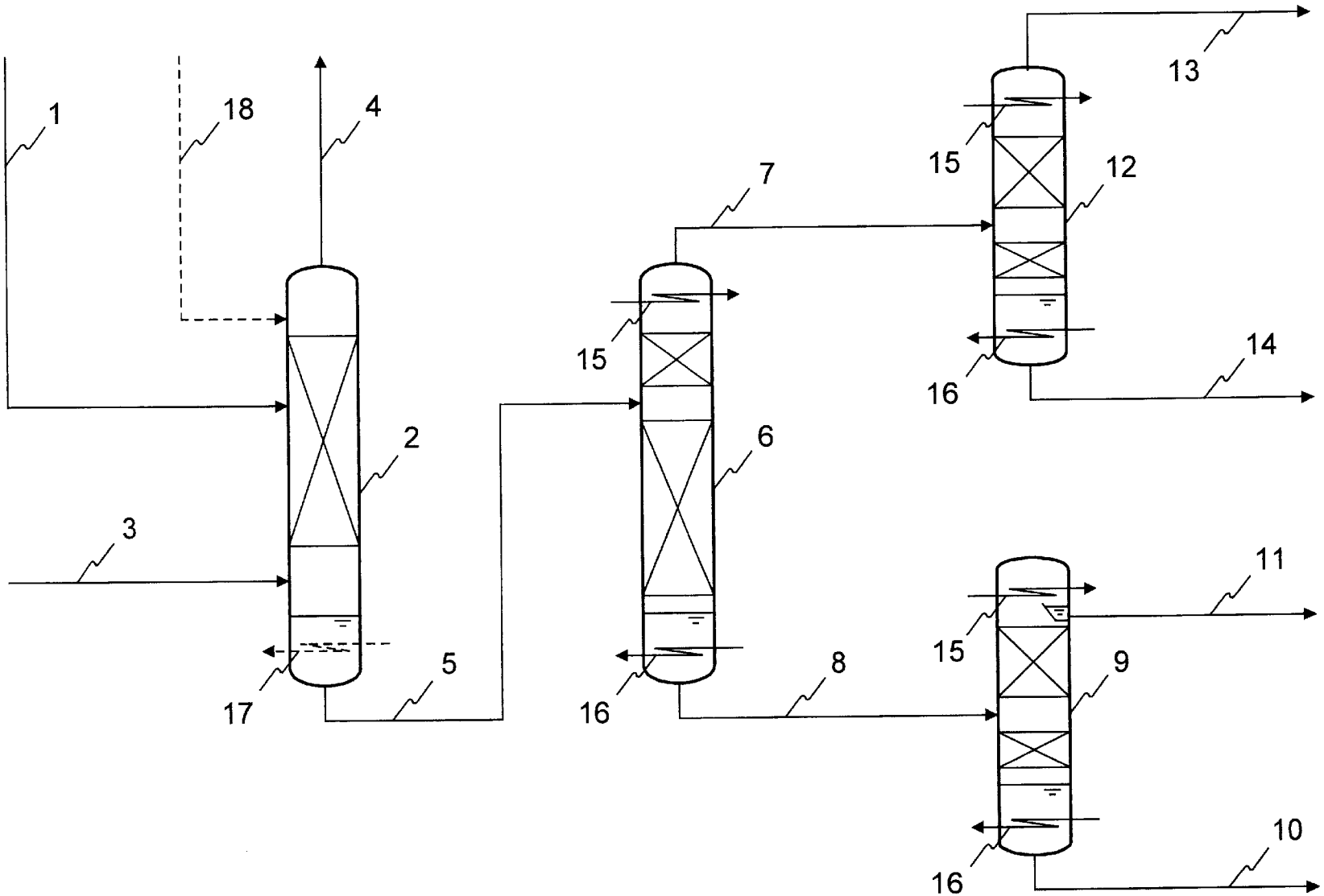
1
2
3
4
5
6
7
8
9
10
11
12
13
14
15
16
17
18

METHOD FOR EXTRACTING XENON

BACKGROUND AND SUMMARY OF THE INVENTION

The invention relates to a process for obtaining xenon and krypton from a liquid oxygen (LOX) charge, with xenon (Xe), krypton (Kr) and hydrocarbons ($C_xH_y$) in a low concentration and approximately 99 mol percent oxygen ($O_2$). The LOX charge is supplied to a 1st column, the oxygen of the LOX charge being largely stripped out by means of an inert gas and being obtained in the head gas, while the inert gas with little $O_2$ and almost the total amount of $C_xH_y$, Kr and Xe is withdrawn in a liquid state from the bottom of the 1st column.

The stripping-off of oxygen by means of argon in a stripping column is known from M. Streich, P. Daimler, "Obtaining Precious Gases in Air and Ammonia Systems", *Linde Berichte aus Technik und Wissenschaft* 37 (1975). As a result of this measure, during the upgrading of the hydrocarbons, together with the krypton and xenon, the oxygen content remains under the ignition limit of a reaction of the hydrocarbons with oxygen.

It is an object of U.S. Patent Document U.S. Pat. No. 4,401,448 to replace the oxygen in such a stripping column by nitrogen.

Subsequently, in both processes, at least a large portion of the hydrocarbons are adsorptively or catalytically removed with a subsequent adsorption of the reaction products water and carbon monoxide. The system necessary for this purpose requires high expenditures. A continuous operation can be achieved only by the alternative charging and regenerating of at least two adsorbers, in which case the process flow with the $C_xH_y$ must be switched at intervals to the respectively regenerated adsorber.

From German Patent Document DE-OS 16 67 639 (see, among others, the claims and the figures with the pertaining explanation in the text), a process is also known which uses a liquid oxygen charge of an air separation system (LZA), in which the oxygen is largely replaced by the inert gas argon. However, the hydrocarbons are removed corresponding to the state of the art known from U.S. Patent Document U.S. Pat No. 4,401,448 and M. Streich by means of adsorption and/or catalytic combustion.

It is therefore an object of the invention to provide a process which is simple and which can be operated without switching the process flow.

According to the invention, this object is achieved by means of a process having the characteristics of claim 1. Further developments of the invention are the object of subclaims.

It is a characteristic of the invention that the withdrawn liquid is supplied to a second column without any previous catalytic and/or adsorptive removal of $C_xH_y$. A Kr fraction is obtained as head gas of the 2nd column and an Xe fraction is withdrawn from the bottom of the 2nd column. The Xe fraction from the bottom of the 2nd column is fed in a center part between the head and the bottom of a 3rd column and a pure Xe product is withdrawn at the head of the 3rd column.

In addition to the Kr, all constituents which boil more easily than Xe, particularly methane, are contained in the Kr fraction. If this Kr fraction is abandoned and only the Xe fraction, which is by one order of magnitude smaller, is processed for obtaining the economically more significant xenon, the process-related expenditures are considerably reduced. In the case of smaller systems, this justifies the elimination of possibly obtaining Kr from the Kr fraction. In an embodiment of the process described below, however, the Kr can also be obtained in a simple manner as an additional product.

The inert gas can be fed above the bottom of the 1st column.

The inert gas can be obtained from an air separation system (LZA) at the site and contain mainly nitrogen and/or argon.

As a result of an air separation system at the site, a required making available of the inert gas is therefore eliminated. If the inert gas contains argon, the argon can be recovered in the air separation system from the head gas of the first column.

The LOX charge can be taken from an air separation system existing at the site. It is less advantageous to transport the LOX charge for obtaining the Xe.

The LOX charge can be fed at the head or several floors below the head of the 1st column.

As required, the pressure of the LOX charge can be adapted to the pressure at the head of the 1st column. Thus, an operating pressure of the first column can be adjusted which is optimal as a function of the inert gas used for the stripping.

The bottom of the 1st column can be heated by an indirect heat exchange. For the heating, an electric heater or a process flow of the air separation system at the site can be used. When an electric heater is used, the process will be independent of the operation of an air separation system; otherwise, electricity costs are saved.

The head of the 1st column can advantageously be cooled by a direct or indirect heat exchange.

In the event of a use of nitrogen as inert gas, liquid nitrogen can be used for cooling the head of the first column. Liquid nitrogen can also easily be made available at sites without an air separation system.

Preferably after a pressure increase, the withdrawn liquid from the 1st column can advantageously be fed several floors below a head condenser of the 2nd column. The pressure increase may be useful in the case of unfavorable hydrocarbon admixtures for avoiding a precipitation of solid matter.

The Xe fraction from the bottom of the 2nd column can be fed in a central part between the head and the bottom of a 3rd column, and a pure Xe product can be withdrawn at the head of the 3rd column. With approximately 99.999 mol percent xenon, this product can at least partially be marketed directly or may possibly at a different site be used for obtaining purest Xe.

The Kr fraction can be fed from the head of the 2nd column into a central part between the head and the bottom of a 4th column, and a pure Kr product can be withdrawn from the bottom of the 4th column. Analogous to the pure Xe product, the pure Kr product with 99,999 mol % krypton can be marketed directly and/or be used for obtaining purest Kr.

The head of the 2nd and/or 3rd and/or 4th column can be cooled and the bottom of the 2nd and/or 3rd and/or 4th column can in each case be heated by an indirect heat exchange by means of a fluid or by means of an electric heater.

The process according to the invention can be used in a device for obtaining Xe and/or Kr at an air separation system.

The device for obtaining Xe and/or Kr can be arranged in a transportable container. This permits, on the one hand, a particularly simple mounting on an air separation system and, on the other hand, such a device can also be used as a mobile device for several air separation systems. For this purpose, it is only necessary to intermediately store LOX charge from the air separation system and process it, when the opportunity arises, in the mobile device. This saves extensive transports of LOX charge, which contains the valuable xenon substance only at approximately 400 mol ppm.

The invention will be explained in detail by means of an embodiment in a FIGURE.

BRIEF DESCRIPTION OF THE DRAWING

According to the invention, the FIGURE shows a purely rectifiable obtaining of Xe without any catalytic or adsorptive $C_xH_y$-removal.

DETAILED DESCRIPTION OF THE DRAWING

The figure illustrates the obtaining of Xe as a basic circuit diagram. An LOX charge is charged at the head of a 1st column 2. This 1st column is essentially used for the exchange of oxygen by an inert gas. In the embodiment illustrated in the figure, a gaseous nitrogen 3 is taken as the inert gas from an adjacent air separation system not illustrated in the figure and is fed above the bottom of this 1st column 2. For reducing the required nitrogen quantity, the bottom of the 1st column 2 can be heated (not shown in the figure). The working pressure of the 1st column 2 depends primarily on the used inert gas. The pressure of the LOX charge 1 is adapted to this working pressure. A residual gas flow 4 at the head of the 1st column 2 contains nitrogen, oxygen and traces of methane and krypton, while a withdrawn bottom liquid 5 contains mainly nitrogen, little oxygen (<5 mol percent), $C_xH_y$, Kr and Xe. The low oxygen content is achieved by not falling below a molar quantity ratio of gaseous nitrogen 3 to LOX charge 1 of approximately 5.0.

The bottom liquid 5 of the 1st column 2 is fed to a 2nd column 6 several floors below the head condenser. For avoiding solid matter precipitation, if necessary, the pressure in the flow 5 can be increased to an optimal operating pressure of the column 6. In the 2nd column 6, a Kr fraction 7 with highly volatile constituents of the flow 5 is obtained, and an Xe fraction 8 is obtained with constituents from the flow 5 which are difficult to volatilize. The Kr fraction 7 is obtained in a gaseous state from the head, and the Xe fraction 8 is obtained in a liquid state from the bottom of the 2nd column 6.

The Xe fraction 8 from the 2nd column 6 is fed into the center part of a 3rd column 9, and a residual gas flow 10, which contains hydrocarbons from the Xe fraction 8 which are difficult to volatilize, is withdrawn in a liquid state from the bottom of the 3rd column 9. A pure Xe product 11 is obtained in a liquid state at the head of the 3rd column 9.

The Kr fraction 7 from the 2nd column 6 is either considered as residual gas or, as illustrated in the figure, is fed into the center part of a 4th column 12, and a residual gas flow 13 with predominantly nitrogen and residual oxygen and methane is removed in a gaseous state at the head of the 4th column 12, and a pure Kr product 14 is withdrawn in a liquid state at the bottom of the 4th column 12.

The head condensers 15 of the 2nd, 3rd and 4th column 6, 9, 12 are cooled by means of an evaporating liquid, which is suitable with respect to its boiling point, or by means of a suitable single-phase cold flow optionally from an adjacent air separation system.

The heating 16 of the 2nd, 3rd and 4th column 6, 9, 12 takes place by an indirect heat exchange by means of an electric heater or a suitable fluid, optionally from an adjacent air separation system.

In another further development of the process according to the invention, the bottom of the 1st column 2 is heated by an indirect heat exchange by means of an electric heater or a suitable fluid 17, and the head of the 1st column 2 is cooled by a direct or indirect heat exchange. (By means of a broken line, the figure shows the heating by means of fluid 17 and the direct heat exchange for the head cooling of the 1st column 2 by means of liquid nitrogen 18.)

EXAMPLE 1

Table 1 shows a numerical example from a model calculation for a further development of the process according to the invention without any head cooling of the first column. The purity of the achieved pure Xe product amounts to 98.8 mol % Xe, and that of the pure Kr product amounts to 98.1 mol %.

The Xe yield amounts to 97.0% and the Kr yield amounts to 67.0% in each case relative to the content in the LOX charge 1.

EXAMPLE 2

For an embodiment as in Example 1, but with bottom heating and with head cooling of the 1st column by introducing liquid nitrogen 18, Table 2 indicates corresponding process data. A xenon purity of 99.97 mol % and a krypton purity of 99.9 mol % are achieved. The Xe yield relative to the content in the LOX charge 1 amounts to 99.8% and the krypton yield amounts to 96.3%.

TABLE 1

| Flow | Temp. K | Pressure bar | Quantity $Nm^3/h$ | $N_2$ % | $O_2$ % | $CH_4$ % | Kr % | Xe % | $C_2H_4$ % | $C_2H_6$ % | $C_3H_8$ % | Phase |
|---|---|---|---|---|---|---|---|---|---|---|---|---|
| 1 | 90.0 | 4.8 | 298.8 | — | 99.1 | 0.4 | 0.4 | 0.04 | 0.002 | 0.05 | 0.01 | 2 |
| 3 | 95.0 | 5.0 | 1529.7 | 99.999 | 0.001 | — | — | — | — | — | — | 1 |
| 4 | 97.9 | 4.8 | 1388.1 | 78.61 | 21.33 | 0.04 | 0.02 | 0.0002 | — | — | — | 1 |
| 5 | 93.8 | 4.9 | 440.4 | 99.56 | 0.0148 | 0.14 | 0.21 | 0.027 | 0.0014 | 0.034 | 0.0068 | 2 |
| 7 | 93.5 | 4.5 | 440.1 | 99.63 | 0.015 | 0.14 | 0.21 | 0.00014 | — | — | — | 1 |
| 8 | 209.2 | 4.5 | 0.3 | — | — | 0.0003 | 0.0072 | 38.65 | 1.96 | 49.47 | 9.91 | 2 |
| 10 | 195.3 | 1.5 | 0.185 | — | — | — | — | 0.099 | 2.48 | 81.17 | 16.25 | 2 |
| 11 | 170.9 | 1.4 | 0.118 | — | — | 0.00076 | 0.018 | 98.83 | 1.15 | — | — | 2 |
| 13 | 92.9 | 4.5 | 439.3 | 99.817 | 0.0148 | 0.14 | 0.028 | — | — | — | — | 1 |
| 14 | 142.4 | 4.5 | 0.822 | 0.028 | 0.0001 | 1.8 | 98.1 | 0.075 | — | — | — | 2 |

Phase: 1 = gaseous
2 = liquid

TABLE 2

| Flow | Temp. K | Pressure bar | Quantity $Nm^3/h$ | $N_2$ % | $O_2$ % | $CH_4$ % | Kr % | Xe % | $C_2H_4$ % | $C_2H_6$ % | $C_3H_8$ % | Phase |
|---|---|---|---|---|---|---|---|---|---|---|---|---|
| 1 | 90.0 | 4.8 | 298.8 | — | 99.1 | 0.4 | 0.4 | 0.04 | 0.002 | 0.05 | 0.01 | 2 |
| 3 | 95.0 | 5.0 | 1112.8 | 99.999 | 0.001 | — | — | — | — | — | — | 1 |
| 4 | 99.1 | 4.8 | 967.9 | 71.09 | 28.87 | 0.03 | 0.0046 | — | — | — | — | 1 |
| 5 | 93.9 | 4.8 | 524.4 | 96.373 | 3.17 | 0.17 | 0.22 | 0.023 | 0.00#1 | 0.029 | 0.0057 | 2 |
| 7 | 94.2 | 4.5 | 524.1 | 96.430 | 3.17 | 0.17 | 0.22 | — | — | — | — | 1 |
| 8 | 209.1 | 4.5 | 0.30 | — | — | 0.00012 | 0.0094 | 39.24 | 1.959 | 49.0 | 9.79 | 2 |
| 10 | 195.6 | 1.6 | 0.187 | — | — | — | — | 0.29 | 3.213 | 80.42 | 16.076 | 2 |
| 11 | 170.9 | 1.4 | 0.12 | — | — | 0.00029 | 0.024 | 99.972 | 0.0035 | — | — | 2 |
| 13 | 93.6 | 4.5 | 522.9 | 96.644 | 3.182 | 0.174 | — | — | — | — | — | 1 |
| 14 | 143.0 | 4.6 | 1.16 | — | — | 0.154 | 99.845 | 0.00084 | — | — | — | 2 |
| 18 | 84.0 | 5.0 | 80.7 | 100.0 | — | — | — | — | — | — | — | 2 |

Phase: 1 = gaseous
2 = liquid

What is claimed is:

1. A process for obtaining xenon and optionally also krypton from a liquid oxygen charge comprising xenon, krypton and hydrocarbons and approximately 99 mol percent oxygen, said process comprising:

feeding the liquid oxygen charge to a first column;

stripping the oxygen out of the liquid oxygen charge by an inert gas and collecting the oxygen in a head gas;

withdrawing the inert gas with some oxygen and almost the total amount of hydrocarbons, krypton, and xenon in a liquid state from the bottom of the first column;

supplying the withdrawn liquid to a second column without any catalytic or adsorptive removal of hydrocarbons;

obtaining a krypton fraction as a head gas of the second column;

withdrawing a xenon fraction from the bottom of the second column;

feeding the xenon fraction to a center part between a head and a bottom of a third column; and withdrawing a pure xenon product at the head of the third column.

2. A process according to claim 1, wherein the inert gas is fed above the bottom of the first column.

3. A-process according to claim 2, wherein the inert gas is from an air separation system.

4. A process according to claim 2, wherein the inert gas contains at least one of nitrogen or argon.

5. A process according to claim 1, wherein the liquid oxygen charge is from an air separation system.

6. A process according to claim 1, wherein the liquid oxygen charge is fed at the head or several floors below the head of the first column.

7. A process according to claim 1, further comprising adapting the pressure of the liquid oxygen charge to the pressure at the head of the first column.

8. A process according to claim 1, further comprising heating the bottom of the first column by an indirect heat exchange.

9. A process according to claim 8, wherein the heating is by an electric heater or a process flow of an air separation system.

10. A process according to claim 1, further comprising cooling the head of the first column by a direct or indirect heat exchange.

11. A process according to claim 10, wherein the inert gas is nitrogen, and the cooling is by liquid nitrogen.

12. A process according to claim 1, wherein the liquid withdrawn from the first column is fed several floors below a head condenser of the second column.

13. A process according to claim 12, wherein the liquid is withdrawn from the first column after a pressure increase.

14. A process according to claim 1, further comprising feeding the krypton fraction from the head of the second column in to center part between a head and a bottom of a fourth column, and withdrawing a pure krypton product from the bottom of the fourth column.

15. A process according to claim 12, further comprising cooling the head of at least one of the second, third, or fourth column.

16. A process according to claim 12, further comprising heating the bottom of at least one of the second, third, or fourth column by an indirect heat exchange by a fluid or by an electric heater.

17. A process according to claim 1, wherein said process is carried out in a system for obtaining at least one of xenon or krypton in an air separation system.

18. A process according to claim 17, wherein the system is arranged in a transportable container.

* * * * *